United States Patent [19]

Alshooler

[11] Patent Number: 4,829,689

[45] Date of Patent: May 16, 1989

[54] ARTICLE FOR DISPLAY OF INFORMATION

[75] Inventor: Norman R. Alshooler, New York, N.Y.

[73] Assignee: Merchandising Workshop, Inc., New York, N.Y.

[21] Appl. No.: 878,427

[22] Filed: Jun. 25, 1986

[51] Int. Cl.[4] ..... G09F 1/10

[52] U.S. Cl. ..... 40/617; 40/642; 40/658; 24/295

[58] Field of Search ..... 40/617, 40 R, 11 R, 40/11 A; 24/295, 457, 573

[56] References Cited

U.S. PATENT DOCUMENTS

| | | | |
|---|---|---|---|
| 275,074 | 8/1984 | Villanueva . | |
| 275,177 | 8/1984 | Villanueva . | |
| 806,229 | 12/1905 | Young | 40/668 |
| 818,012 | 4/1906 | Andrews | 40/649 |
| 2,331,086 | 10/1943 | Taylor | 40/649 |
| 2,720,044 | 10/1955 | Montalto . | |
| 2,859,546 | 11/1958 | Gutterson . | |
| 3,091,875 | 6/1963 | Crafa . | |
| 3,288,414 | 11/1966 | Fortunato . | |
| 3,753,305 | 8/1973 | Mueh . | |
| 3,884,443 | 5/1975 | McMaster . | |
| 3,899,841 | 8/1975 | Berger . | |
| 3,977,019 | 8/1976 | Berry, Jr. | 40/124.1 |
| 4,215,840 | 8/1980 | Babberl . | |
| 4,420,082 | 12/1983 | Bernie . | |
| 4,477,048 | 10/1984 | Conway . | |
| 4,646,454 | 3/1987 | Fast | 40/124.1 |
| 4,754,563 | 7/1988 | Fast | 40/124.1 |

FOREIGN PATENT DOCUMENTS

| | | | |
|---|---|---|---|
| 976917 | 12/1964 | United Kingdom | 40/649 |
| 1443179 | 7/1976 | United Kingdom | 40/642 |

*Primary Examiner*—Henry E. Raduazo

*Attorney, Agent, or Firm*—Amster, Rothstein & Ebenstein

[57] ABSTRACT

An article for displaying information made of a sheet material with at least one cutout that permits the article to be mounted to a suitable display mounting means. The mounting means should be provided with a post projecting substantially perpendicular to the base of the mounting means. The post should have means for engaging the cutouts provided in the inventive display article thereby permitting the mounting means to hold the display article. Such engaging means are preferably a pair of hooks that extend toward the base of the mounting means from the end of the projecting post. The display article is designed to contact the base of the mounting means at a plurality of points so that the display article is securely held in place by the combination of the selected engaging means of the post of the mounting means and the multiple contact points between the display article and base of the mounting means.

10 Claims, 2 Drawing Sheets

ARTICLE FOR DISPLAY OF INFORMATION

This invention relates generally to a shelf display flag. More particularly, this invention relates to a device that is intended to call special attention to certain goods or merchandise on store shelves by displaying novel aisle flags in a fashion whereby such flags pertrude from the plane of the shelf so that they may be readily visible to approaching shoppers.

Aisle flags for example, as price indicators, both alone and in combination with means for mounting, are generally known, e.g., U.S. Pat. Nos. 1,174,299, 2,297,888 and 4,483,502. Currently known devices, however, are usually difficult to construct, requiring the molding or shaping of the aisle flags to the shelf mounting means or shaping the shelf mounting means to securely fit the shelf or requiring that both be performed. Moreover, such devices are unable to display the aisle flags they support in a pertruding fashion so that shoppers and other persons in the area may readily take notice of the items they connote from a distance while looking in a direction parallel to the aisle.

The invention concerns both a novel display flag, which may be mounted for display to any suitable mount, as well as a combination of the display mounted to a particular mount. The mount contemplated for use in the inventive combination is the subject of patent design application Ser. No. 644,502, filed Aug. 24, 1984.

It is therefore an object of the present invention to provide a display flag, such as, for example, an aisle display flag to indicate price, that is capable of being readily and conveniently mountable to a structure designed to receive such display sheets.

It is a further object of the invention to provide a combination display flag and mount that displays information which may be readily noticed by persons in the vicinity of the display.

It is still a further object of the invention to provide a combination display flag and mount that can be conveniently and economically constructed.

Accordingly, the foregoing and related objects of the invention are achieved by providing a display flag made of a sheet mounted to suitable display mounting means. The display mounting means includes a base adapted to be received in an existing store shelf and, preferably, further includes a post projecting substantially perpendicular to the base of the display mounting means. The post has engaging means for engaging the cutout provided in the display flag thereby permitting the display mounting means to hold the display flag. Such engaging means are preferably a pair of arcuate hooks formed at the outer end of the post, the ends of which extend toward the base of the mounting means. The display flag is preferably designed to contact the base of the mounting means at a plurality of points so that the display flag is securely held in place by the combination of the engaging means of the post of the mounting means receiving the cutout in the display flag and the multiple contact points between the display and base of the mounting means. Additionally, the inventive display flag may be made from either a single sheet of the sheet material used or more than one sheet, such as, two sheets.

It is further desirable to provide the portion of the display flag that contacts the base of the mounting means with at least one outwardly extending tab to engage at least one corresponding opening in the mounting means so that the display flag may be more securely held in place.

Other objects and features of the present invention will become apparent from the following detailed description when taken in combination with the accompanying drawings, which disclose several embodiments of the invention. It is to be understood that the drawings are designed for the purpose of illustration only and are not intended as a definition of the limits of the invention.

In the drawings, wherein similar reference numerals denote similar elements through the several views.

Figure 1:
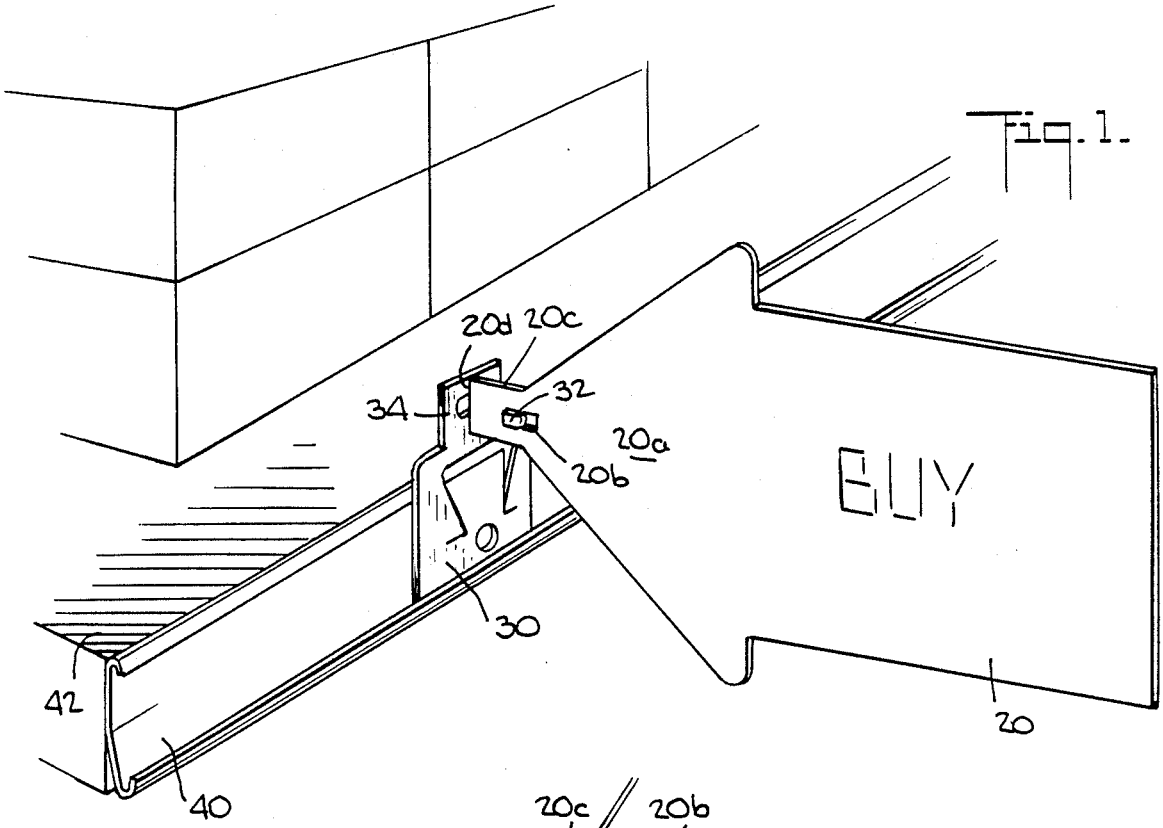
FIG. 1 is a perspective view of the combination of a single sheet display flag and mount engaging a store shelf in accordance with the invention.

Turning now to a detailed description of the presently preferred embodiments, FIG. 1 shows, generally, an embodiment of the inventive display flag 20 in combination with mount 50 engaged with shelf display track 70. Display flag 20 is made of a sheet material, preferably, paper or cardboard, though other materials such as plastic or wood may be utilized. The particular embodiment of display flag 20 shown in FIG. 1 is arrow-shaped so that it may direct a shopper's interest to certain items that are to be displayed on the store shelf 72. However, it should be recognized that other shaped display flags can also be used. Display flag 20 is provided with tapered segment 22 which terminates in a rectangular segment 24 providing a multi-point contact edge 26 between display flag 20 and mount 50 thereby securing the display flag to the mount.

Figure 2:
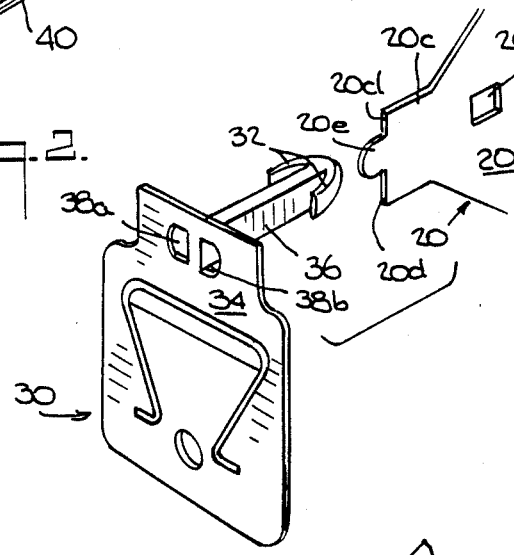
FIG. 2 is a perspective view of a mount for displaying the display flag and a fragmented view of a display flag prior to its mounting.

FIG. 2 shows mount 50 and display flag 20 (fragmented) prior to engagement and additional features of both. The embodiment presented of display flag 20 is a single sheet display flag that includes tapered segment 22 and rectangular segment 24 having multi-point contact edge 26 extending therefrom. The display flag illustrated also includes a tab 28 extending from the multi-point contact edge 26 to provide a more secure hold of the display flag 20 by mount 50. It should be noted, however, that the inventive display flag does not require such tab 28 for a proper and secure engagement with the mount 50 or other suitable mount. Finally, FIG. 2 also shows that display flag 20 includes a cutout 30 for engagement with mount 50 in a manner to be described in greater detail hereinafter.

As further shown in FIG. 2, mount 50 is shown having a planar base 52 which includes openings 54*a*, 54*b* as well as means for securing mount 50 to a shelf display track 70 (see FIG. 1). Mount 50 secures shelf display track 70 by means of a cantilever 51 that is cut out from base 52 and wedges the top of cantilever 51 and the bottom of base 52 within flanges 74*a*, 74*b*, respectively of shelf display track 70. Extending in a substantially perpendicular direction from base 52 is a post 56. As shown, openings 54*a*, 54*b* are positioned adjacent to post 56. The end of post 56 has means for engaging display flag 20. In the embodiment shown in FIG. 2, that means is an arrow head 58 having arcuate members 58*a*, 58*b* extending toward base 52 from the end of post 56. As will be explained in greater detail shortly, one arcuate member is inserted through cutout 30 to aid in mounting display flag 20 to mount 50.

Figure 3:
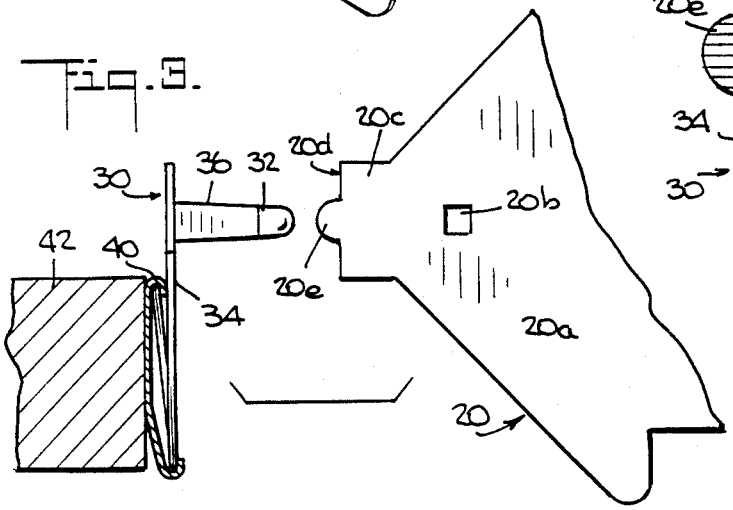
FIG. 3 is a side view of a mount engaging a store shelf and a fragmented view of the inventive display flag prior to its mounting.

Referring to FIG. 3, illustrated is a fragmented portion of display flag 20 prior to engagement with mount 50. Mount 50 is shown engaging shelf display track 70 of shelf 72 in the manner discussed heretofore. Post 56 of the mount is shown pertruding perpendicularly from base 52 with the arrow head 58 of the post extending toward the base.

Figure 4:
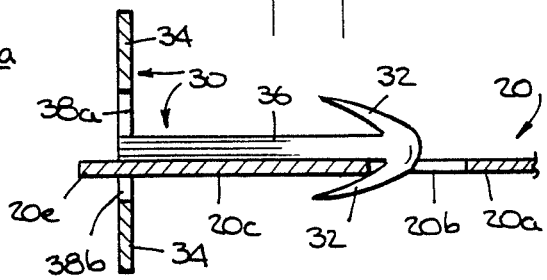
FIG. 4 is a plan view showing the combination fag with tab and mount.
Figure 5:
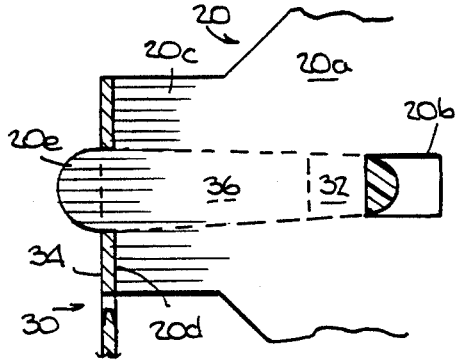
FIG. 5 is a side view, in elevation, showing the combination display flag engaging a mount.

FIGS. 4 and 5 are plan and side views, respectively, which show in detail how display flag 20 is secured to mount 50 according to the invention. As shown, one member 58*b* of the arrow head 58 passes through cutout 30 of the display flag 20. Cutout 30 is positioned so that its distance from multi-point contact edge 26 (see FIGS. 2 and 3) is substantially equal to the length of post 56 of mount 50. As a result, when one of the arcuate members 58*a*,58*b* of arrow head 58 of post 56 is passed through cutout 30, the display is positioned parallel to and abuts post 56 with multi-point contact edge 26 being wedged against base 52 of mount 50 by an interference fit to secure the display flag to the mount. The embodiment in FIGS. 4 and 5 is provided with tab 28 though, as mentioned above, such a feature is optional. Tab 28, which extends from multi-point contact edge 26, is passed through opening 54*b* in base 52 for additional mounting stability between display flag 20 and mount 50.

Figure 6:
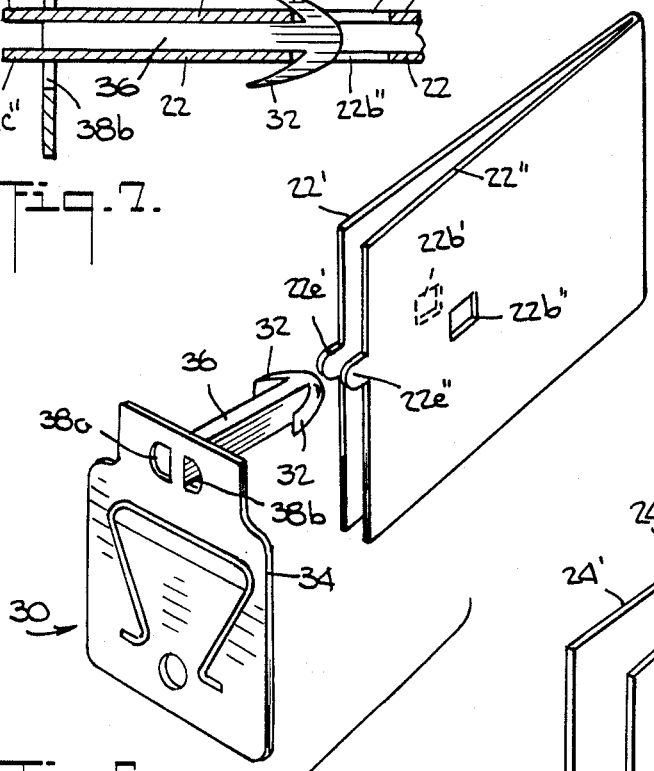
FIG. 6 is a perspective view of a mount for displaying an inventive double-sheet display flag prior to mounting the display flag to the mount.

FIG. 6 shows a double-sheet display flag 32 and mount 50 prior to engagement. Display flag 32 is two sheets of a material, such as paper, cardboard, plastic or wood that may be made by joining together one edge of each of two separate sheets of a material or, instead, may be made from a single sheet of material that is appropriately folded in half. The embodiment of double-sheet display flag 32 illustrated in FIG. 6 is substantially rectangular, though it should be recognized that other shapes can be used. This embodiment was made by using one sheet material and folding it in half. For purposes of discussion, each half will be referred to as a separate sheet and designated by reference numerals 34*a*, 34*b*. Each sheet is also provided with a cutout 36*a*, 36*b* for engagement to mount 50, which will be discussed in more detail below, in a fashion analogous to the engagement between display flag 20 and mount 50. Finally, the embodiment presented includes tabs 38*a*, 38*b* extending from multi-point contact edges 40*a*, 40*b* for a more secure hold by the mount 50 of the double-sheet display flag 32. As in the case of display flag 20, such tabs are optional. The mount 50 illustrated in FIG. 6 has a similar construction to the mount 50 used to mount display flag 20 which has been described earlier.

Figure 7:
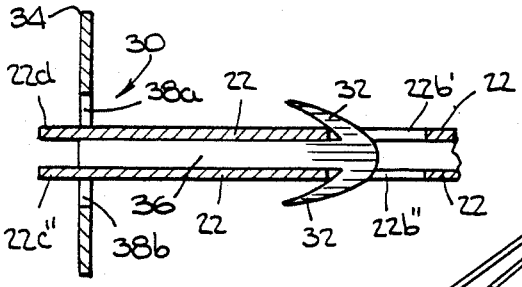
FIG. 7 is a top view showing the combination double-sheet display flag with tabs and a mount according to the invention.

Referring to FIG. 7, illustrated is a plan view of double-sheet display flag 32 secured to mount 50 according to the present invention. Each member 58*a*, 58*b* of the arrow head of post 56 is passed through a cutout 36*a*, 36*b* of sheets 34*a*, 34*b*, respectively. Cutouts 36*a*, 36*b* are each positioned so that its distance from multi-point contact edges 40*a*, 40*b*, respectively, are substantially equal to the length of post 56 of mount 50. Accordingly, when each member of arrow head 58 of post 56 is passed through a cutout 36*a*, 36*b*, the display flag is positioned parallel to and abuts post 56 with the post being positioned between the two sheets 34*a*, 34*b* and with multi-point contact edges 40*a*, 40*b* being wedged against base 52 of the mount 50 on opposite sides of post 56 thereby securing by interference fits the display flag 32 to the mount 50. Tabs 38*a*, 38*b* pass, respectively through openings 54*a*, 54*b* in base 52 for a more secure fit between the double-sheet display flag 32 and the mount 50.

Figure 8:
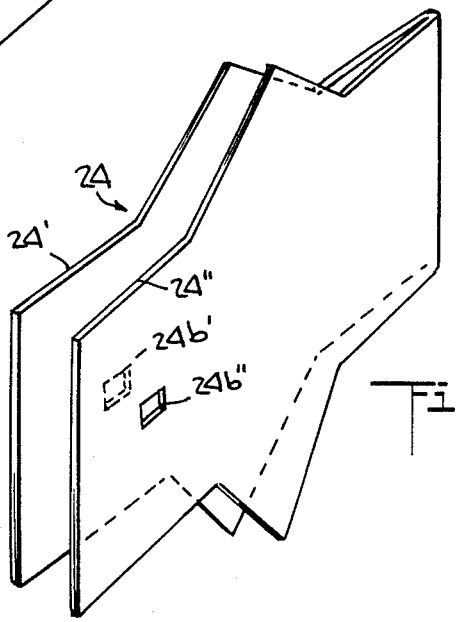
FIG. 8 is a perspective view of a preferred embodiment of a double-sheet display flag.

FIG. 8 illustrates another double-sheet display flag 44 having a different configuration with sheets 44*a*, 44*b* having cutouts 45*a*, 45*b* and multi-point contact edges 46*a*, 46*b*. As previously mentioned, the display flag according to the invention may have, literally, an endless number of possible shapes and sizes. All that is necessary is a multi-point contact edge and a cutout through at least one sheet of the display flag positioned a distance from the multi-point contact edge that is substantially equal to the size of the post of the mount to which the display flag is to be engaged. Finally, it should be noted that the display flag illustrated in FIG. 8 does not include tabs extending from the multi-point contact edges 46*a*, 46*b* which are to contact the base of the mount.

Figure 9:
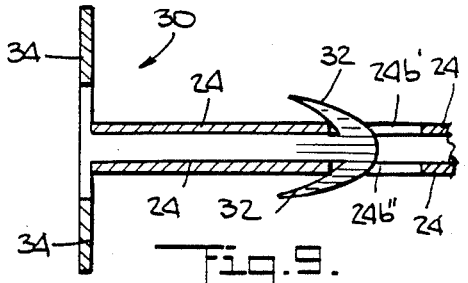
FIG. 9 is a top view showing the combination double-sheet display flag (without tabs) and mount.

FIG. 9 is a plan view showing the engagement between display flag presented in FIG. 8, and mount 30. The engagement between the display flag 44 and the mount 26 is identical to the engagement shown in FIG. 7 between double-sheet display flag 32 and mount 50 except for the absence of tabs on double-sheet display flag 44.

Figure 10:
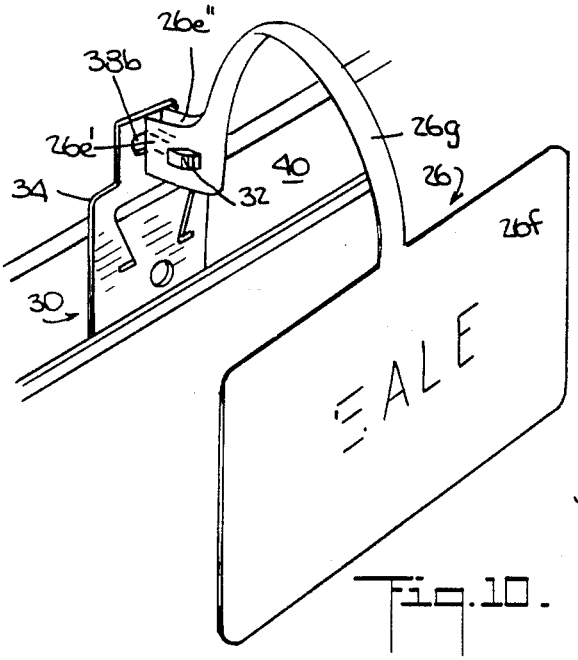
FIG. 10 is a perspective view of yet another preferred embodiment of a combination double-sheet display flag and mount engaging a store shelf.

FIG. 10 shows yet another embodiment of a display flag 45 in combination with mount 50. Mount 50, in turn, is shown engaging a store shelf in the manner previously indicated. Display flag 47 has display face 46 which faces parallel to the store shelf and which conveys intended information to those in the vicinity of display flag 47. The intended message is to appear on display face 46 which, of course, may have any number of shapes. Display face 46 is suspended in such manner that its existence can be ascertained from a distance by a person looking parallel to the aisle thereby attracting attention to the display flag. A flexible stem 47 extends from the top of display face, extends from rectangular segments 48*a*, 48*b*. Each rectangular segment is provided with a cutout 49*a*, 49*b* to engage mount 50. The engagement between display flag 45 and mount 50 is similar to the engagement between display flag 41 and the engagement illustrated in FIG. 9.

Figure 11:
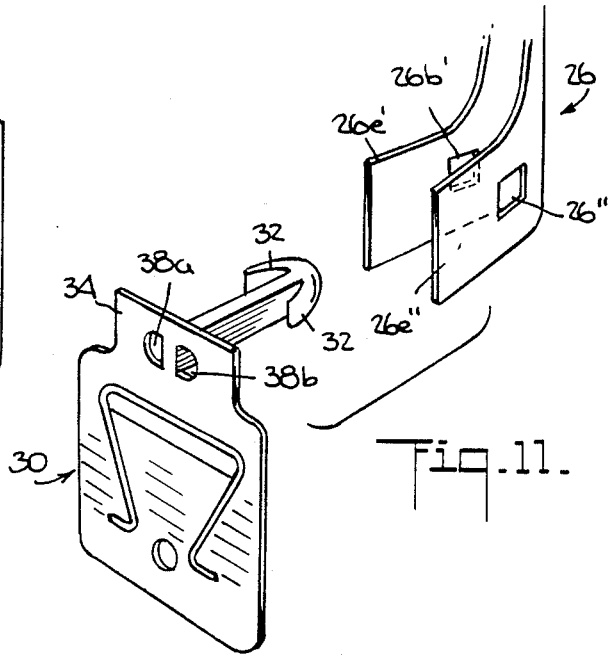
FIG. 11 is a perspective view of a mount for displaying the inventive display flag and a fragmented view of the double-sheet display flag of FIG. 10 prior to mounting the display flag to the mount.

Finally, FIG. 11 illustrates mount 50 and a fragmented view of display flag 45 prior to engagement. For engagement of the display flag to the mount, the display flag is provided with rectangular segments 48*a*, 48*b*. These segments are each provided with cutouts 49*a*, 49*b* so that each rectangular segment is capable of engaging one arcuate member 58*a*, 58*b* of the arrowhead of post 56. The engagement between display flag 45 and mount 50 is identical to the engagement shown in FIG. 7 between double-sheet display flag 32 and the mount except for the absence of tabs on display flag 45.

It should be apparent that other variations may be made as will be apparent to those skilled in the art. For example, the inventive display flags may be provided with numerous shapes other than those disclosed herein. In addition, the display flags may be made from numerous materials.

Thus, while only several embodiments of the present invention have been shown and described, it will be obvious that many changes and modifications may be made thereunto without departing from the spirit and scope of the invention.

What is claimed is:

1. An article for displaying information comprising:

a display flag; and means for mounting said display flag including a base and a post extending substantially perpendicular from said base, said post having means for engaging said display flag;

said display flag being a sheet-like material having at least one edge and including at least one cutout spaced from said edge by a distance selected so that said engaging means of said mounting means can engage said spaced cutout of said display flag thereby securing said display flag to said mounting means;

said post having an arrow-shaped head having two half arrow members as said means for engaging said display flag so that, at least, one of said half arrow members is threaded through said spaced cutout of said display flag, thereby securing said display flag parallel to said post between said arrow-shaped head and said base of said mounting means by means of an interference fit.

2. The article according to claim 1, wherein said sheet-like material of said display flag is a paper-like material.

3. The article according to claim 1, wherein said sheet-like material of said display flag is plastic.

4. The article according to claim 1, wherein said sheet-like material of said display flag is wood.

5. The article according to claim 1, wherein the distance between said means for engaging of said post and said base of said means for mounting is substantially equal to the distance between said cutout and said edge of said display flag.

6. The article according to claim 1, wherein said base of said mounting means has at least one aperture adjacent to said post.

7. The article according to claim 6, wherein said display flag includes a tab extending from said edge of said sheet-like material to engage said aperture of said mounting means by means of an interference fit thereby providing a more secure mounting of said display flag.

8. The article according to claim 1, wherein said sheet-like material of said display flag has two halves, each of said halves having at least one of said cutouts spaced from an edge of said flexible sheet-like material so that the cutouts and the edge of said display flag engage said mounting means.

9. The article according to claim 8, further comprises at least one tab extending from said edge of each of said halves of said flexible sheet-like material to engage an aperture within said base of said mounting means by means of an interference fit, said aperture being adjacent to said post of said mounting means, thereby providing a more secure mounting of said display flag.

10. The article according to claim 1, further comprising markings on said sheet-like material.

* * * * *